US006210628B1

(12) United States Patent
Booth et al.

(10) Patent No.: US 6,210,628 B1
(45) Date of Patent: Apr. 3, 2001

(54) MELT DELIVERY SYSTEM

(75) Inventors: Lloyd M. Booth, Kent City; David L. Kring, Whitehall, both of MI (US); Martin A. Callaway, Nallen, WV (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/221,496

(22) Filed: Dec. 28, 1998

(51) Int. Cl.[7] ..... C21B 7/12

(52) U.S. Cl. ..... 266/45; 266/208; 266/211; 222/590

(58) Field of Search ..... 266/45, 200, 208, 266/211; 222/590, 594; 164/7.1, 61, 65, 136, 133, 256, 257, 258

(56) References Cited

U.S. PATENT DOCUMENTS 3,565,156 * 2/1971 Vollmer et al. ..... 164/258
4,917,359 * 4/1990 Ichikawa et al. ..... 266/208
5,335,711 * 8/1994 Paine ..... 164/65
5,634,514 * 6/1997 Gagliano ..... 164/136
5,753,004 * 5/1998 Hanai et al. ..... 266/211
5,819,837 * 10/1998 Hugo et al. ..... 164/61

* cited by examiner

*Primary Examiner*—Scott Kastler

(57) ABSTRACT

Melt delivery system and method including a first melting chamber and a laterally adjacent second melt pour chamber arranged side-by-side to one another with a suitable isolation valve therebetween. A melting/melt delivery system is includes a transport mechanism having a horizontally translatable carriage disposed on a carriage support frame. A shaft mechanism is disposed on the carriage for rotation relative thereto and for carrying a melting vessel in a manner that the melt-filled vessel can be horizontally translated from the melting chamber where a charge is melted in the vessel to the adjacent mold pour chamber where the melt is poured into a casting mold or vessel by rotation of the shaft mechanism. The carriage is translated by an actuator on the carriage support frame, and the shaft mechanism is independently rotated by an actuator on the carriage. The carriage support frame carries a sealing door disposed about the shaft mechanism to mate with the melting chamber to seal it from ambient atmosphere during vacuum melting of the charge in the melting vessel and translation of the melting vessel to the pour chamber.

13 Claims, 2 Drawing Sheets

MELT DELIVERY SYSTEM

FIELD OF THE INVENTION

The present invention relates to a melt delivery system for use in casting molten metals.

BACKGROUND OF THE INVENTION

In the vacuum casting of molten metals, such as superalloys, a superalloy charge is melted in a melting furnace vessel (e.g. crucible) in an upper melting chamber usually under vacuum and then poured into casting mold positioned in a lower mold pour chamber located beneath the melting chamber and communicated thereto via an open isolation valve. In many cases, the molten metal pour stream height from the melting vessel above the underlying refractory mold is reduced by raising the mold in the lower mold pour chamber using an elevator or other mold lift mechanism. However, in the case of fixed mold height equipment, the distance of the mold from the melting vessel results in an inherently long molten metal pour stream that is difficult to control and can introduce molten metal turbulence within the mold during mold filling.

An object of the present invention is provide a melt delivery system that substantially reduces the length of the melt pour stream from a melting vessel to a casting vessel, such as a mold or shot sleeve, and overcomes problems associated with the above described upper melting chamber/lower mold pour chamber system.

SUMMARY OF THE INVENTION

The present invention provides a melt delivery system and method including a melting chamber and a laterally adjacent pour chamber arranged side-by-side to one another. A melt delivery system includes a transport mechanism having a horizontally translatable carriage disposed on a carriage support frame. A shaft mechanism has one end disposed on the carriage and another end disposed on the frame for translation and rotation relative thereto for carrying a melting vessel, such as for example an induction melting crucible, in a manner that the melt-filled vessel can be horizontally translated from the melting chamber where a metal charge is melted in the vessel to the adjacent pour chamber where the melt is poured into a casting vessel, such as a casting mold or shot sleeve of a die casting machine, by rotation of the shaft mechanism. The carriage is translated by an actuator motor on the carriage support frame, and the shaft mechanism is independently rotated by an actuator motor on the carriage. The carriage support frame carries a sealing door disposed about the shaft mechanism to mate with the melting chamber to seal it from ambient atmosphere during vacuum melting of the charge in the melting vessel and translation/rotation of the melting vessel.

In an embodiment of the invention, the shaft mechanism comprises a coaxial shaft arrangement wherein an inner tube is disposed in an intermediate tube to provide coolant and electrical power supplies to the melting vessel. The inner and intermediate tubes are disposed in an outermost support tube. The melting vessel is mounted on the outermost support tube and is connected to coolant and electrical power supplies via the shaft mechanism.

The above objects and advantages of the present invention will become better understood by reference to the following detailed description when considered in conjunction with the accompanying drawings.

DETAILED DESCRIPTION OF THE INVENTION

Figure 1:
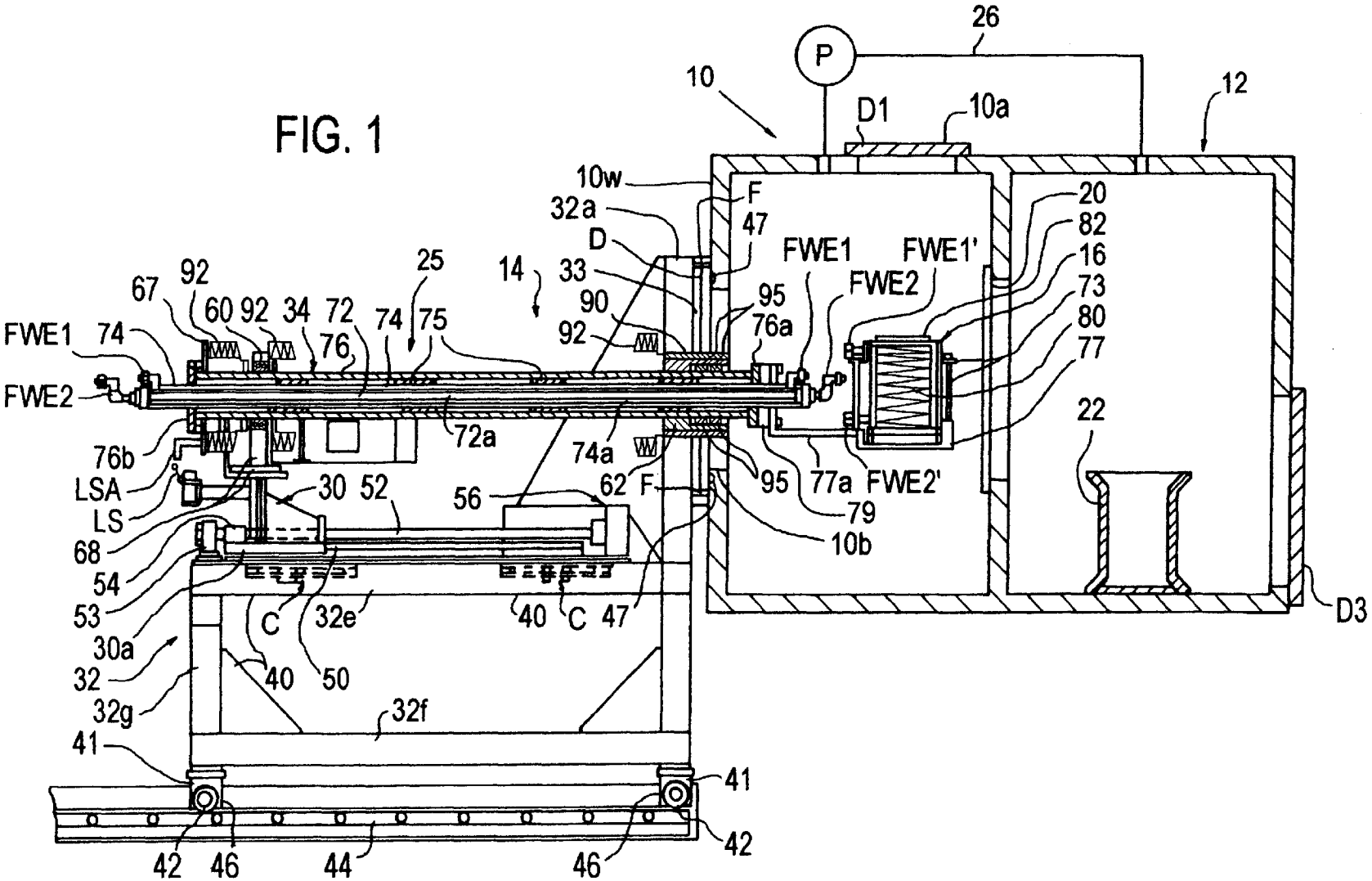
FIG. 1 is an elevation of the melt delivery system of an embodiment of the invention and a side-by-side melting chamber and pour chamber.
Figure 2:
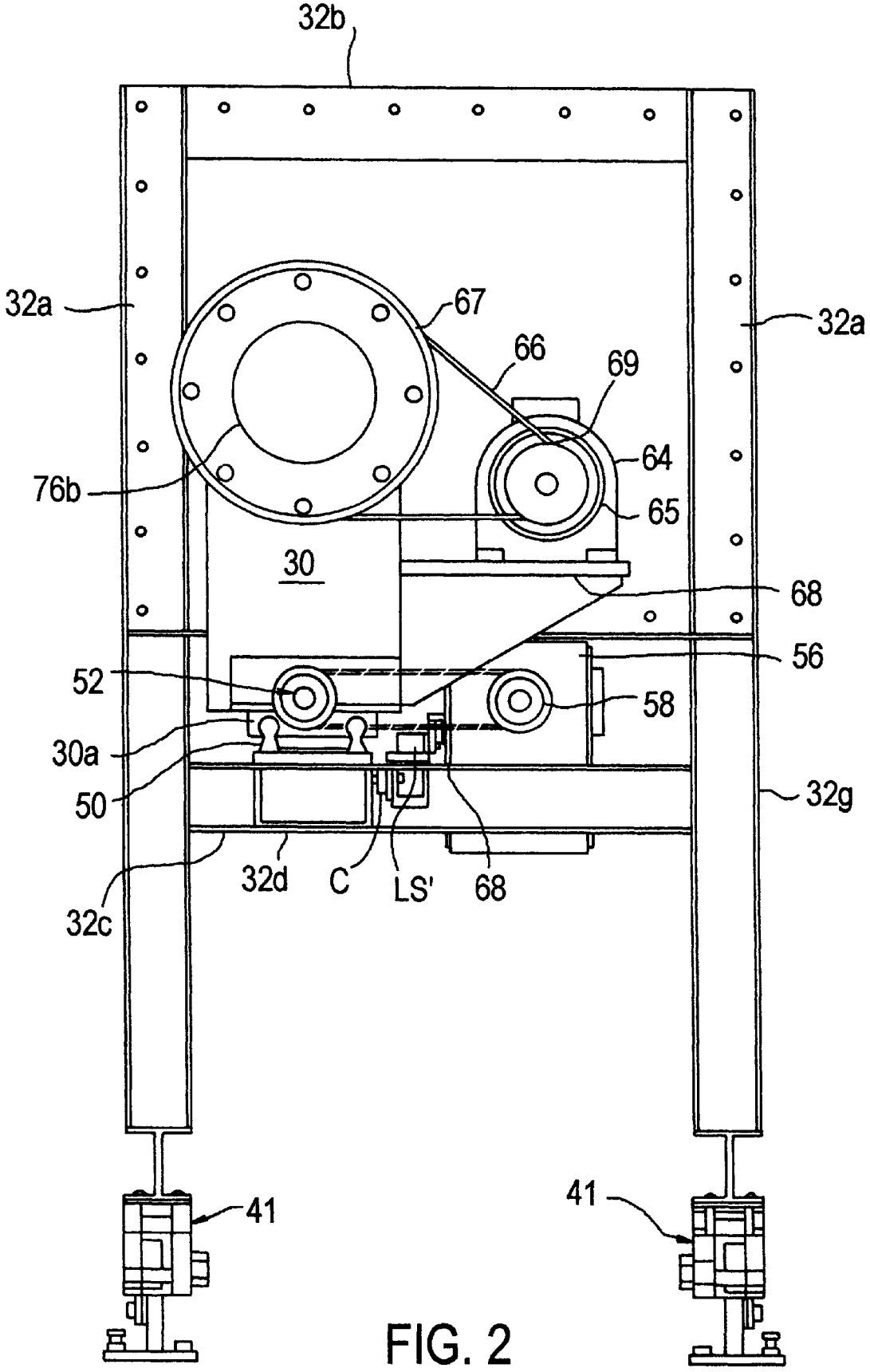
FIG. 2 is an end elevation of the melt delivery system showing the carraige.

Referring to FIGS. 1–2, apparatus for casting molten metal is illustrated including a first melting chamber 10 and a laterally adjacent second pour chamber 12 arranged side-by-side to one another and a melt delivery system 14.

The melting chamber 10 comprises a metal-walled chamber communicated to a vacuum pump P such that a vacuum in the range of 0.001 to 0.010 torr typically can be provided, for example only, during melting of a nickel or cobalt base superalloy solid charge (e.g. ingot) in the melting vessel 16 disposed on the melt delivery system 14. The melting vessel 16 typically comprises an induction melting crucible described in more detail below. The melting chamber 10 includes a first access opening 10*a* for charging the melting vessel 16, the opening lO*a* being vacuum tight sealed by access door D1, and a second opening 10*b* in a side wall proximate the melt delivery system 14 for closure by a seal door D in a manner described below. The pour chamber 12 comprises a metal-walled chamber communicated to the melting chamber 10 by a movable isolation gate type or other valve 20 shown schematically. The valve 20 is slidable to a closed position when the metal charge is being melting in melting vessel 16 under vacuum and opened to permit the melt-filled melting vessel 16 to be moved by the melt delivery system 14 into the pour chamber 12 for pouring of the melt from the melting vessel 16 into a casting vessel such as a casting mold 22, which may comprise a ceramic or metal refractory mold. The mold 22 is inserted in position in the mold pour chamber while the charge is being melted under vacuum in the melting chamber 10. The casting mold 22 is positioned through a vacuum tight sealable access door D3 of the chamber 12 by a mold positioning device (not shown), such as a mechanical arm of a robot or manually using a mold positioning arm. After the mold is positioned in the chamber 12, the door D3 is closed to provide a vacuum tight seal, and the chamber 12 is evacuated by the vacuum pump P via conduit 26, or by a separate vacuum pump (not shown) communicated thereto.

In lieu of casting mold 22, a shot sleeve (not shown) of a die casting machine can reside in the pour chamber 12 as a casting vessel as described for example in copending Ser. No. 08/928,842 now U.S. Pat. No. 6,070,643 and 09/012,347 now U.S. Pat. No. 6,012,840 of common assignee herewith, the teachings of which are incorporated herein by reference. The shot sleeve receives a charge of molten material from the melt delivery system of the invention; e.g. poured from melting vessel 16. The shot sleeve is communicated to one or more die casting molds. A plunger in the shot sleeve introduces the molten charge in the shot sleeve into the die casting mold(s) for solidification.

The melt delivery system 14 includes a transport mechanism 25 having a horizontally translatable carriage 30 disposed on a carriage support frame 32 and a shaft mechanism 34 disposed on the carriage 30. The carriage support frame 32 includes a steel frame weldment 40 having four wheel restraining mounts 41 by which four steel wheels (cam rollers) 42 are rotatably mounted to ride on a pair of parallel steel rails 44 so that the frame 32 can be moved adjacent to the melting chamber 10 as shown. A railscrapper blade 46 is provided outboard of each respective wheel 42 in close tolerance fit to the side of each rail to scrape and remove excess metal spatter from the rails 44 to reduce rolling resistance.

The carriage support frame 32 includes a pair of spaced apart vertical support posts 32*a* connected by upper and lower front horizontal frame members 32*b*, 32*c*. The posts 32*a* and frame members 32*b*, 32*c* support the end of the melt delivery system 14 adjacent the melting chamber 10 in a manner to be described below. The translatable carriage 30 is supported at the other end of the frame 32 by horizontal support frame member 32*d* and posts 32*g*. The frame 32 includes pairs of upper and lower side frame members 32*e*, 32*f* connected by welding to the aforementioned frame posts and frame members to form the frame weldment.

The carriage support frame 32 carries seal plate door D on the front end thereof to vacuum tight close the opening 10*b* of the melting chamber 10 to maintain the vacuum in chamber 10 during melting. The door D is fastened by suitable fasteners F to a frame plate 33 fastened on the carriage support frame 32. The support frame 32 is manually moved or driven by any suitable motor means to position the seal door D in vacuum tight sealing relation to the melting chamber 10. To this end, the door D has disposed thereon a conventional annular beehive seal 47 that seals on end wall lO*w* of the melting chamber 10 to achieve a vacuum tight seal therebetween when the frame 32 is positioned as shown in FIG. 1. The beehive seal 47 includes linear upper and lower and side sections positioned on door D between parallel metal rods (not shown) that are fastened (e.g. welded) on the door D on opposite sides of the beehive seal and arcuate corner sections outside of the rods such that the beehive seal extends about the opening 10*b*, which may be rectangular or any other shape for accesss to the melting chamber 10.

The carriage 30 is mounted for translation relative to the support frame 32 after the frame is positioned to seal the door D and the melting chamber 10. In particular, the carriage includes a pillow block 30*a* disposed on a pair of parallel slideways 50 on the frame 32. The carriage 30 is translated on slideways 50 relative to the frame 32 by rotation of a ball screw 52 that is mounted on the frame 32 by ball screw bearing supports 53 and that is received in a ball nut 54 fastened on the carriage 30. The ball screw 52 is rotated by an actuator servomotor 56 and associated gear reducer mounted on frame 32. A conventional roller chain and sprocket drive 58 is provided between the servomotor 56 and the ball screw 52 to rotate the ball screw.

The shaft mechanism 34 is mounted at its rear end on the carriage 30 by anti-friction bearings 60 mounted on platform 68 and at its front end on frame 32 by inner copper bushing 62 such that the shaft mechanism 34 can be translated and rotated relative to the frame 32. The shaft mechanism is translated by moving the carriage 30 on slideways 50. The shaft mechanism 34 is rotated by an actuator servomotor 64 and gear reducer 65 mounted on the carriage 30 via a conventional roller chain drive 66 and annular chain sprocket 67 disposed on the shaft mechanism proximate cap 76*b* and sprocket 69 of an output shaft of servomotor 64/gear reducer 65. The servomotor 64 is mounted on a cantilevered platform 68. One or more conventional limit switches can be provided to control rotation of the shaft mechanism 34 as well as linear travel of the carriage 30. For example, a limit switch shown includes limit switch arm LSA mounted for rotation with sprocket 67 and a non-rotating arm-actuated switch LS to control servomotor 64. similar conventional limit switches LS', FIG. 2, actuated by carriage movement are provided to control servomotor 56 in response to linear carriage movement are mounted on channels C fastened axially apart on frame 32. Carriage movement is controlled in a manner that positions melting vessel 16 in melting chamber 10 and then in pour chamber 12, and vice versa, during operation of the melt delivery system.

The shaft mechanism 34 comprises a coaxial shaft arrangement wherein an inner cylindrical copper tube 72 is disposed in an intermediate cylindrical brass tube 74 with the opposite tube ends being capped or closed. Inner tube 72 provides a water coolant supply passage 72*a* and functions as an electrical supply conductor, while annular water coolant return passage 74*a* is provided between the tubes 72,74 with tube 74 providing the other electrical conductor of the melting vessel. The intermediate tube 74 is disposed by annular insulators 75 in an outermost cylindrical steel support tube 76, which is mounted at one capped end on the carriage 30 by the anti-friction bearings 60 and the other capped end on frame 32 by the bushing 62. The ends of the tube 76 are capped or closed off by end caps 76*a*, 76*b*.

The induction melting vessel 16 is mounted by bracket 73 on a metal slosh pan 77. The pan 77 includes arm 77*a* mounted on the end of the outermost support tube 76 by fasteners with a thermal insulating block 79 therebetween. The induction melting vessel 16 includes fittings FWE1' and FWE2' connected to complementary fittings FWE1 and FWE2 on the end of the support tube 76 for providing coolant and electrical power supplies carried by the internal tubes 72, 74. Similar fittings are provided at the opposite end of support tube 76 as shown in FIG. 1 (omitted from FIG. 2 for convenience) to connect to cooling water and electrical power supplies. Electrical power and coolant water are provided to a water cooled induction coil 80 disposed about the ceramic crucible 82 by the fittings and tubes 72, 74. The thermal insulator block 79 thermally isolates the support tube 76 from the heat of the melting vessel 16.

The frame 32 and seal door D include a bronze bushing 90 disposed about the copper bearing or bushing 62. Various conventional O-ring or U-shaped seals (quad seals) can be axially arranged between the bushings 62, 90 and bushing 90 and frame 32 as necessary to provide a vacuum tight sealing when the door D is sealed by seal 47 on wall 10*w* of melting chamber 10. Muliple (e.g. three) conventional vacuum seal packs 95 (two shown), such as POLYPAK seal from Parker Hannifin Corporation, and associated O-ring seals are axially arranged between the copper bushing 62 and the tube 76 in a radially enlarged region of the bushing 62 to this same end. A similar vacuum seal pack and associated O-ring seal (not shown) can be positioned between the end cap 76*a* and the intermediate tube 74. Flexible dust boots 92 shown partially broken away are disposed about the shaft mechanism 34 at various locations.

In practice of a method embodiment of the invention, a solid charge, such as a superalloy ingot, is placed via sealable access door D1 in the melting vessel 16 disposed on the shaft mechanism 34 in a melting chamber 10 with the door D vacuum tight sealed relative to the melting chamber 10 and with the isolation valve 20 closed. A vacuum then is drawn in the melting chamber 10, and the induction coil 80 is energized to melt the charge to form a melt in the melting vessel 16. Before or during melting of the charge, a casting vessel, such as casting mold 22, is positioned in the mold pour chamber 12, which is then vacuum tight sealed and evacuated. Alternately, a shot sleeve of a die casting machine would be permanently positioned in the pour chamber 12 to receive a molten metal charge poured from the melting vessel 16 in an alternative embodiment where the shot sleeve is part of a die casting machine. After the melt is formed in the melting vessel 16, the isolation valve 20 is opened and the melting vessel 16 filled with melt is translated by carriage 30/servomotor 56 into the mold pour chamber 12 above the casting vessel (e.g. the mold or shot sleeve). The shaft mechanism 34 then is rotated by servomotor 64 to pour the melt from the melting vessel 16 into the underlying casting vessel 22. The now empty melting vessel 16 then is rotated back to its original position and moved from the mold pour chamber 12 back into the melting chamber 10 with the isolation valve 20 then closed to repeat the above described melting and melt delivery cycle. The present invention is advantageous to provide a substantially shortened molten metal pour stream from the melting vessel to the mold in the mold pour chamber.

While the invention has been described in terms of specific illustrative embodiments thereof, it is not intended to be limited thereto but rather only to the extent set forth hereafter in the following claims.

What is claimed is:

1. Melt delivery system, comprising a melting chamber and a laterally adjacent melt pour chamber communicating to one another, and a transport mechanism having a carriage disposed on a carriage support frame for translation relative thereto and a shaft mechanism disposed on said carriage for rotation relative to said carriage, said shaft mechanism carrying a melting vessel between said melting chamber and said pour chamber, and first actuator means for translating said carriage to move said melting vessel from said melting chamber after a charge is melted in said vessel to said pour chamber and second actuator means for rotating said shaft mechanism relative to said carriage in a manner to pour melt from said melting vessel.

2. The system of claim 1 wherein said carriage support frame includes a sealing door disposed about said shaft mechanism to mate with said melting chamber in a manner to seal it from ambient atmosphere during vacuum melting of a charge in said melting vessel.

3. The system of claim 1 wherein said shaft mechanism comprises a coaxial shaft arrangements wherein an inner tube is disposed in an intermediate tube to provide coolant and electrical power supplies to said melting vessel and an outermost support tube which is mounted on said carriage at one end and on a fixed carriage support frame at another end.

4. The system of claim 3 wherein said melting vessel is mounted on said outermost support tube and is connected to said coolant and electrical power supplies.

5. The system of claim 1 wherein said melting chamber and said pour chamber are communicated by valve means therebetween.

6. Method of casting a melt into a mold, comprising melting a charge in a melting vessel disposed on a shaft mechanism in a melting chamber and translating said shaft mechanism to move said melting vessel with a melt therein to a laterally adjacent melt pour chamber, and rotating said shaft mechanism in a manner to pour said melt into a casting vessel positioned in said pour chamber.

7. The method of claim 6 including translating a sealing door to mate with said melting chamber in a manner to seal it from ambient atmosphere during vacuum melting of a charge in said melting vessel in said melting chamber.

8. The method of claim 6 wherein coolant and energy for melting said charge are supplied to said melting vessel through said shaft mechanism.

9. The method of claim 6 including rotating said shaft mechanism to pour said melt into said casting vessel comprising a shot sleeve of a die casting machine.

10. The system of claim 1 including a vacuum pump communicated to said melting chamber.

11. The system of claim 1 including a vacuum pump communicated to said pour chamber.

12. The method of claim 6 wherein melting of said charge is conducted under vacuum.

13. The method of claim 6 wherein pouring of said melt is conducted under vacuum.

* * * * *

UNITED STATES PATENT AND TRADEMARK OFFICE

CERTIFICATE OF CORRECTION

PATENT NO. : 6,210,628 B1
DATED : April 3, 2001
INVENTOR(S) : Lloyd M. Booth, et al.

It is certified that error appears in the above-identified patent and that said Letters Patent is hereby corrected as shown below:

Column 5,
Line 36, change --- arrangements" to -- arrangement --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*